US005119859A

United States Patent [19]

Sato et al.

[11] Patent Number: 5,119,859

[45] Date of Patent: Jun. 9, 1992

[54] STEAM GOVERNING VALVE

[75] Inventors: Takeshi Sato; Seiki Taketomo; Isao Fujita; Naohiko Iwata, all of Hitachi, Japan

[73] Assignee: Hitachi, Ltd., Tokyo, Japan

[21] Appl. No.: 489,105

[22] Filed: Mar. 6, 1990

[30] Foreign Application Priority Data

Mar. 6, 1989 [JP] Japan ..... 1-051849

[51] Int. Cl.[5] ..... F16K 1/00

[52] U.S. Cl. ..... 137/630.13; 137/630.14

[58] Field of Search ..... 137/630.13, 630.14, 137/630.15

[56] References Cited

U.S. PATENT DOCUMENTS

| | | | |
|---|---|---|---|
| 3,575,213 | 4/1971 | Schnall | 137/630.15 |
| 4,928,733 | 5/1990 | Sudolnik | 137/630.14 X |

FOREIGN PATENT DOCUMENTS

| | | | |
|---|---|---|---|
| 261954 | 2/1960 | Australia . | |
| 1804242 | 6/1969 | Fed. Rep. of Germany | 137/630.15 |
| 20891 | 6/1972 | Japan | 137/630.15 |
| 108104 | 8/1979 | Japan | 137/630.13 |
| 44263 | 11/1980 | Japan . | |
| 147002 | 7/1987 | Japan . | |
| 1002613 | 3/1983 | U.S.S.R. | 137/630.14 |

*Primary Examiner*—Robert G. Nilson

*Attorney, Agent, or Firm*—Antonelli, Terry, Stout & Kraus

[57] ABSTRACT

A steam governing valve includes a valve body constituting a main valve together with a main valve seat formed on a casing body and having a smaller valve seat inside thereof, a valve rod movable in the valve body in an axial direction of the valve and constituting a smaller valve together with the smaller valve seat, a sleeve arranged in the casing body and guiding the valve body in an axial direction, and a pressure chamber defined by the casing body, the valve body and the sleeve. The pressure chamber communicates with an entrance chamber through a clearance provided on the sliding portions of the sleeve and valve body, and the main valve is opened by lifting the valve rod beyond the fully open position of the smaller valve. The valve body is formed on the cylindrical outer surface thereof with a plurality of axially extending grooves arranged at equal intervals in a circumferential direction. The sleeve is formed with a plurality of steam passages at positions opposite to the axially extending grooves and the pressure chamber communicates with the entrance chamber through the steam passages and the axially extending grooves when the valve body is lifted beyond a predetermined valve opening degree.

1 Claim, 7 Drawing Sheets

STEAM GOVERNING VALVE

BACKGROUND OF THE INVENTION

The present invention relates to a steam governing valve used in a steam turbine, and in particular, to a steam governing valve in which the vibration of the valve body in a large opening degree of the valve body can be suppressed and a stabilized motion of the valve body can be obtained.

As shown in FIG. 6 a conventional steam governing valve comprises a casing body 1, an upper cover 2, a bush 3 secured to the upper cover 2, a valve rod 4 slidably fitted in the bush 3, a sleeve 7 secured to the casing body 1, a valve body 6 slidably fitted in the sleeve 7 with a clearance 8 interposed therebetween and forming a main valve 15, control means for controlling the valve rod 4, a smaller valve body 13 formed at the lower end portion of the valve rod 4, a smaller valve seat 14 formed on the valve body 6, a main valve seat 16 formed on the casing body 1, an entrance chamber 18 formed in the casing body 1, an inlet port 21, an outlet port 22, a pressure chamber 19 defined by the valve body 6, the sleeve 7 and the upper cover 2, and a flow passage 20 formed in the valve body 6.

The valve rod 4 is formed at its lower portion with a valve rod shoulder 5, and the valve body 6 is formed with a projection 6*a* adapted to engage with the shoulder 5.

The control means for controlling the valve rod 4 are composed of a hydraulic actuator 9, a lever 11 connected at one end thereof with a piston rod 10 of the hydraulic actuator 9 and at the other end thereof with the valve rod 4 through a pin 17 and rotatably supported at its middle portion by a stationary member, and a compression spring 12 always pressing the valve rod 4 downwards with a constant force Fs.

A vertical motion of the piston rod 10, produced by increasing or decreasing the hydraulic pressure of the hydraulic actuator 9, is transmitted to the valve rod 4 through the lever 11. When the valve rod is moved upwardly, the compression spring 12 is compressed. When the lift amount of the valve rod 4 is smaller than the maximum lift amount l, the valve body 6 continues to be in close contact with the main valve seat 16, and the valve rod shoulder 5 is separated from the projection 6*a*. As a result, a high pressure steam flows from the entrance chamber 18 through the clearance 8 between the sleeve 7 and the valve body 6 into the pressure chamber 19, and then flows out through a gap between the valve rod shoulder 5 and the projection 6*a* and a gap between the smaller valve body 13 and the smaller valve seat 14, and through the flow passage 20 towards the outlet port 22.

When the valve rod 4 is further lifted upwardly beyond the maximum lift amount ( of the smaller valve, the valve rod shoulder portion 5 engages with the projection 6*a* and moves the valve body 6 upwardly. As a result, the valve body 6 is separated from the main valve seat 16, and the main valve 15 is opened to a opening degree L. In this state, the steam in the entrance chamber 18 flows out directly to the outlet port 22.

FIG. 7 shows the pressure $P_1$ at the entrance chamber 18, the pressure $P_3$ at the pressure chamber 19 and the pressure $P_2$ at the outlet port 22 in relation to the valve opening degree in the above-mentioned state of the valve.

When the valve body 6 is moved to a position corresponding to a predetermined valve opening degree L, the valve rod 4 receives a force $F_P$ which depends on the pressure $P_1$ in the entrance chamber 18, the pressure $P_3$ in the pressure chamber 19 and the pressure $P_2$ at the outlet port 22. The relationship between the above-mentioned force $F_P$, the force F acting on the valve rod 4 from the hydraulic actuator 9 and the force $F_S$ from the compression spring 12 is expressed by the following equation:

$$F = F_P + F_S$$

The compression force $F_S$ of the compression spring 12 linearly varies according to the change of the valve opening degree, while the force $F_P$ depends upon various pressures of the steam varies in a complex manner according to the valve opening degree. Considering the force $F_P$ acting on the valve rod 4, as shown in FIG. 8, the force $F_P$ is very small until the smaller valve body 13 is fully opened, sharply increases the instant when the main valve 15 starts to open, and gradually decreases as the valve opening degree of the main valve increases. This force $F_P$ is expressed in the following equation (1):

$$F_p = \underbrace{\frac{\pi}{4}(P_1 - P_2)(D_1^2 - D_2^2)}_{(a)} + \underbrace{\frac{\pi}{4}(P_3 - P_2)(D_2^2 - D_3^2)}_{(b)} + \underbrace{\frac{\pi}{4}(P_a - P_3)D_4^2}_{(c)}$$

where, $P_1$; pressure in the entrance chamber 18, $P_2$; pressure at the outlet port 22, $P_3$; pressure at the pressure room 19, $P_a$; atmospheric pressure, $D_1$; outside diameter of the lower end of the valve body 6

$D_2$; diameter of the outlet port 22, $D_3$; diameter of the flow passage 20, and $D_4$; diameter of the valve rod 4.

In FIG. 8, in a range of the valve opening degree from zero to l, the term (c) is predominant in the equation (1), and the force $F_P$ is negative, because $P_a < P_3$.

When the valve rod shoulder 5 engages with the projection 6*a* and the main valve 15 starts to open, the terms (a), (b) and (c) are all effective in the equation (1), and the force $F_P$ acting on the valve rod 4 starts to sharply increase. When the valve opening degree further increases, the pressure $P_2$ increases as shown in FIG. 7. As a result, the pressure differences $(P_1 - P_2)$ in the term (a) of the equation (1) and $(P_3 - P_2)$ in the term (b) decrease, and accordingly, the force $F_P$ acting on the valve rod 4 decreases. At a valve opening degree nears the full opening $L_o$, the force $F_P$ becomes very small, namely regarded as $F_P \approx 0$. In other words, the engaging force for maintaining an engagement between the valve rod 4 and the valve body 6 becomes very small, and the motion of the valve body 6 becomes very unstable in the valve axial direction (direction along the force $F_P$), although it is guided by the sleeve 7.

In a steam governing valve used near at the full opening degree $L_o$, the steam flows at high speed through the main valve 15, and diffuses to the outlet port 22. As a result, in the downstream side of the main valve 15, a steam flow state including severe disturbances is generated. The pressure variation caused by the above-mentioned flow disturbances acts on the valve body 6, thereby producing an abnormal vibration of the valve body 6 which is in an unstable condition as mentioned above.

The characteristic of the force $F_P$ acting on the valve rod 4 of the prior art shown in FIG. 8 is a result of providing the smaller valve 13. The advantage of providing the smaller valve 13, as understood from FIGS. 7 and 8, is that the force acting on the valve rod 4 when the main valve starts to open can be decreased by $\Delta F$, and accordingly, a hydraulic actuator having a small size and a light weight can be obtained. However, there is a disadvantage that the engaging force between the valve rod 4 and the valve body 6 is small when the main valve is largely opened as mentioned above, and the valve body 6 is brought into an unstable condition.

Japanese Patent Laid-open No. 62-147002 discloses a steam governing valve improved with respect to the steam flow state around the valve body when the main valve 15 is slightly opened. In this steam governing valve, each of the sleeve 7 and valve body 6 is formed with through holes extending in directions perpendicular to the valve axis, and these through holes overlap each other when the smaller valve 13 has been fully opened and the main valve 15 is slightly opened, thereby producing a communication between the entrance chamber 18 and the pressure room 19. By virtue of this arrangement, the steam flow rate through the flow passage 20 of the smaller valve 13 is increased, the mixing of the steam flow through the flow passage 20 with the steam flow from the main valve 15 is improved, and the steam flow at the outlet port 22 is stabilized, thereby decreasing the force of the fluid which may excite the vibration of the valve body 6. However, as mentioned above, the overlapping or communication between the through holes is obtained only in a range where the main valve opening degree is small, but no communication is obtained in a range where the main valve opening degree is near the fully open state. Therefore, the steam governing valve of this type has also a disadvantage that the motion of the valve body become unstable when the valve is moved to near the full open position.

The object of the present invention is to provide a steam governing valve in which the vibration of the valve body is suppressed even when the valve body moves in the valve opening direction beyond a predetermined valve opening degree, and the motion of the valve body is stabilized.

SUMMARY OF THE INVENTION

For achieving the above-mentioned object, in a steam governing valve according to an embodiment of the present invention, the valve body is formed with a plurality of axially extending grooves on the outer cylindrical surface thereof at equal circumferential intervals, and the sleeve is formed with steam flow passages at positions opposite to the above-mentioned axially extending grooves for communicating the entrance chamber with the axially extending grooves. The steam governing valve functions so that, when the valve body moves beyond a predetermined valve opening degree, the entrance chamber and the pressure chamber communicate with each other through the steam flow passages of the sleeve and the axially extending grooves of the valve body.

Further, in order to increase the pressure in the pressure chamber for stabilizing the motion of the valve body at its fully open condition, each of the total cross-sectional area of the plural axially extending grooves and the total cross-sectional area of the plural flow passages formed in the sleeve has a flow cross-sectional area greater than that of the smaller valve at its full open condition.

For making the motion of the valve body more stable, in a steam governing valve according to another embodiment of the present invention, a plurality of compression springs are arranged above the valve body in the pressure chamber at equal circumferential intervals, and adapted to press the valve body downwardly when the valve body moves beyond a predetermined valve opening degree.

When the valve rod is lifted beyond a predetermined lift amount (maximum gap between the smaller valve and the smaller valve seat), the valve rod engages with the valve body and the valve body is moved in a valve opening direction. When the valve body is lifted in the valve opening direction beyond a predetermined valve opening degree, a communication is produced between the entrance chamber and the pressure chamber through steam flow passages formed in the sleeve and axially extending grooves formed in the valve body. As a result, the steam in the entrance chamber flows through the steam flow passages formed in the sleeve and the axially extending grooves formed in the valve body into the pressure chamber, thereby increasing the pressure $P_3$ in the pressure chamber. When the pressure $P_3$ in the pressure chamber is increased, it becomes possible to increase a force acting on the valve rod, as understood from the equation (1). By increasing the force acting on the valve rod, the engaging force between the valve rod and the valve body is increased. Consequently, the vibration of the valve body can be suppressed and the motion of the valve body can be stabilized.

According to a second embodiment of the present invention, in the process of lifting the valve rod beyond a predetermined lift amount with the valve rod engaging with the valve body, the force acting on the valve rod is the same as in the prior art, until the valve opening degree reaches a predetermined value. When the valve body further moves in a valve opening direction beyond a predetermined valve opening degree, the valve body compresses the compression springs arranged in the pressure room above the valve body. Since the compression force of the compression springs increases the engaging force between the valve rod and the valve body, the vibration of the valve body is suppressed and the motion of the valve body is stabilized.

DESCRIPTION OF THE PREFERRED EMBODIMENTS

Figure 1:
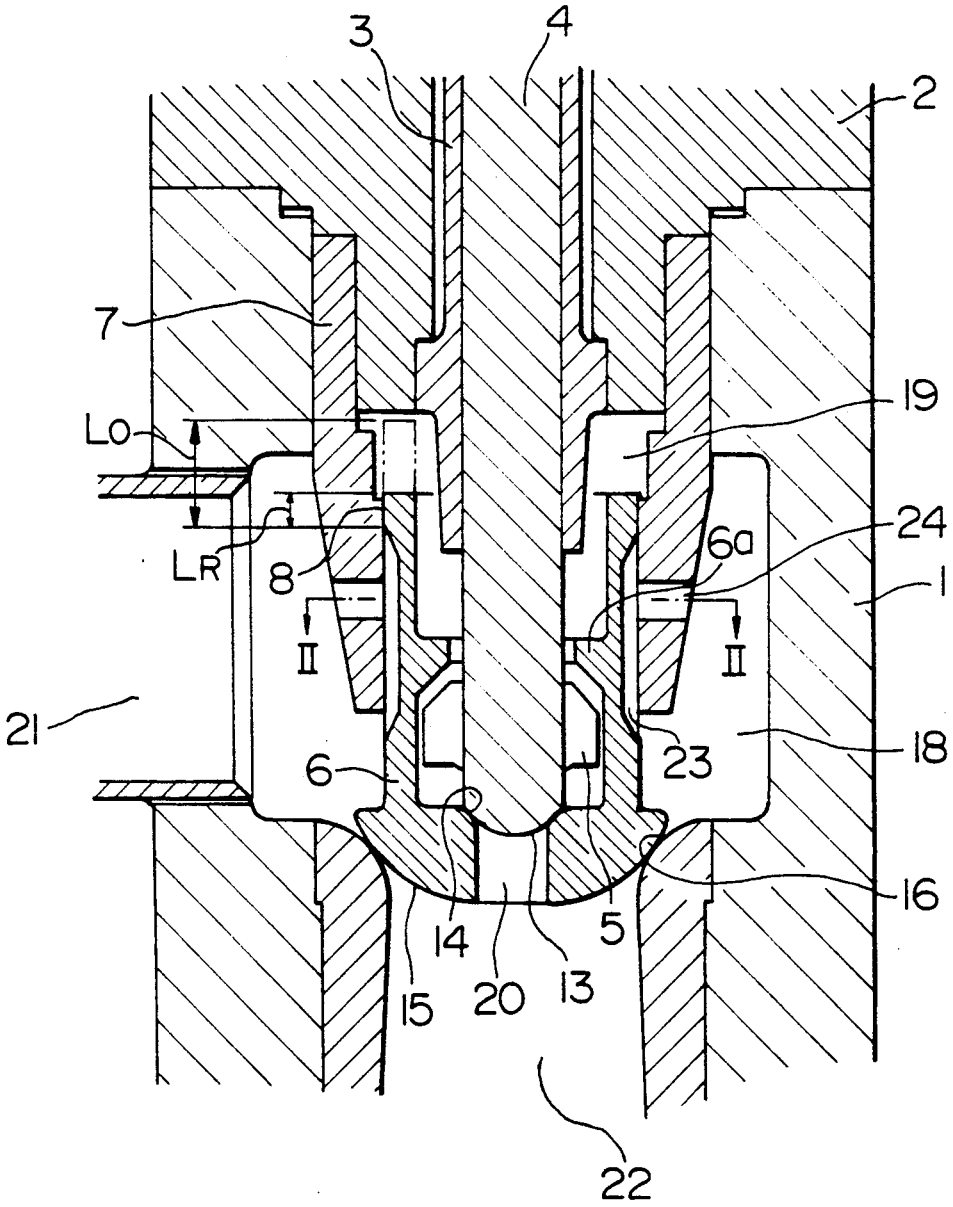
FIG. 1 is a longitudinal sectional view of a steam governing valve according to a first embodiment of the present invention.
Figure 2:
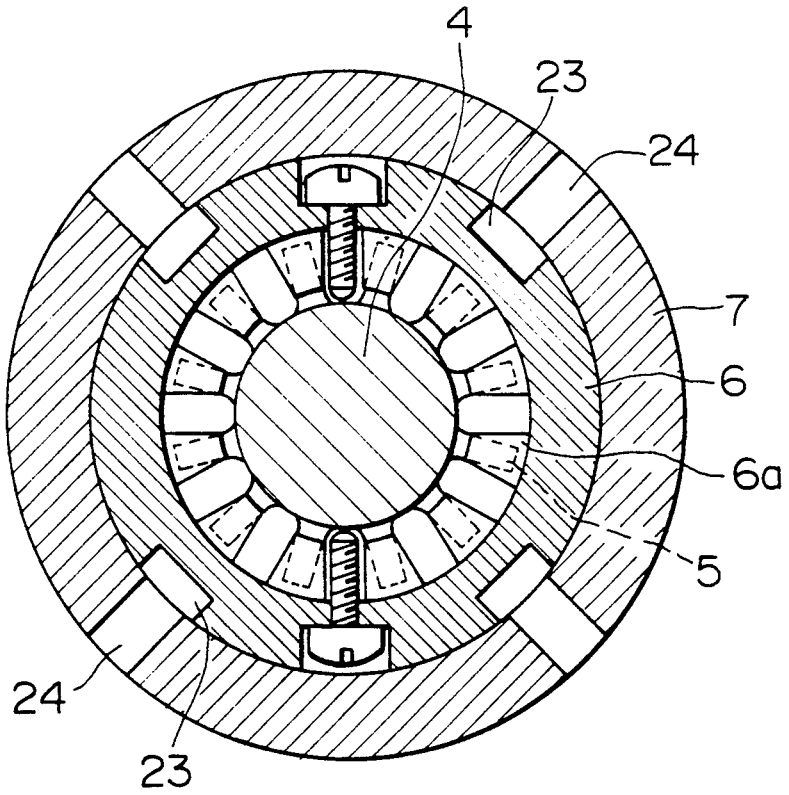
FIG. 2 is an enlarged sectional view taken along line II—II of FIG. 1.
Figure 6:
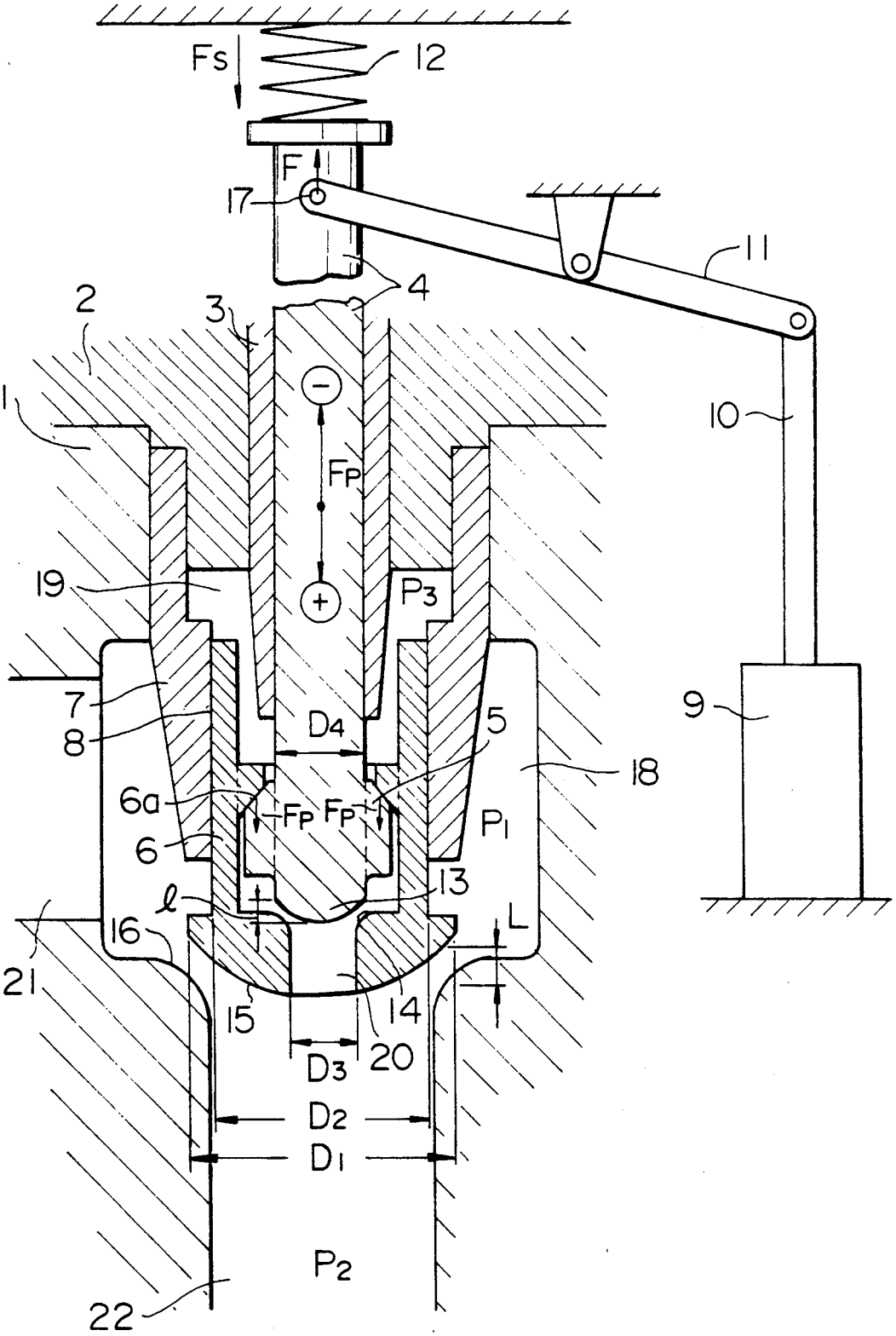
FIG. 6 PRIOR ART
FIG. 6 is a longitudinal sectional view showing a prior art.
Figure 7:
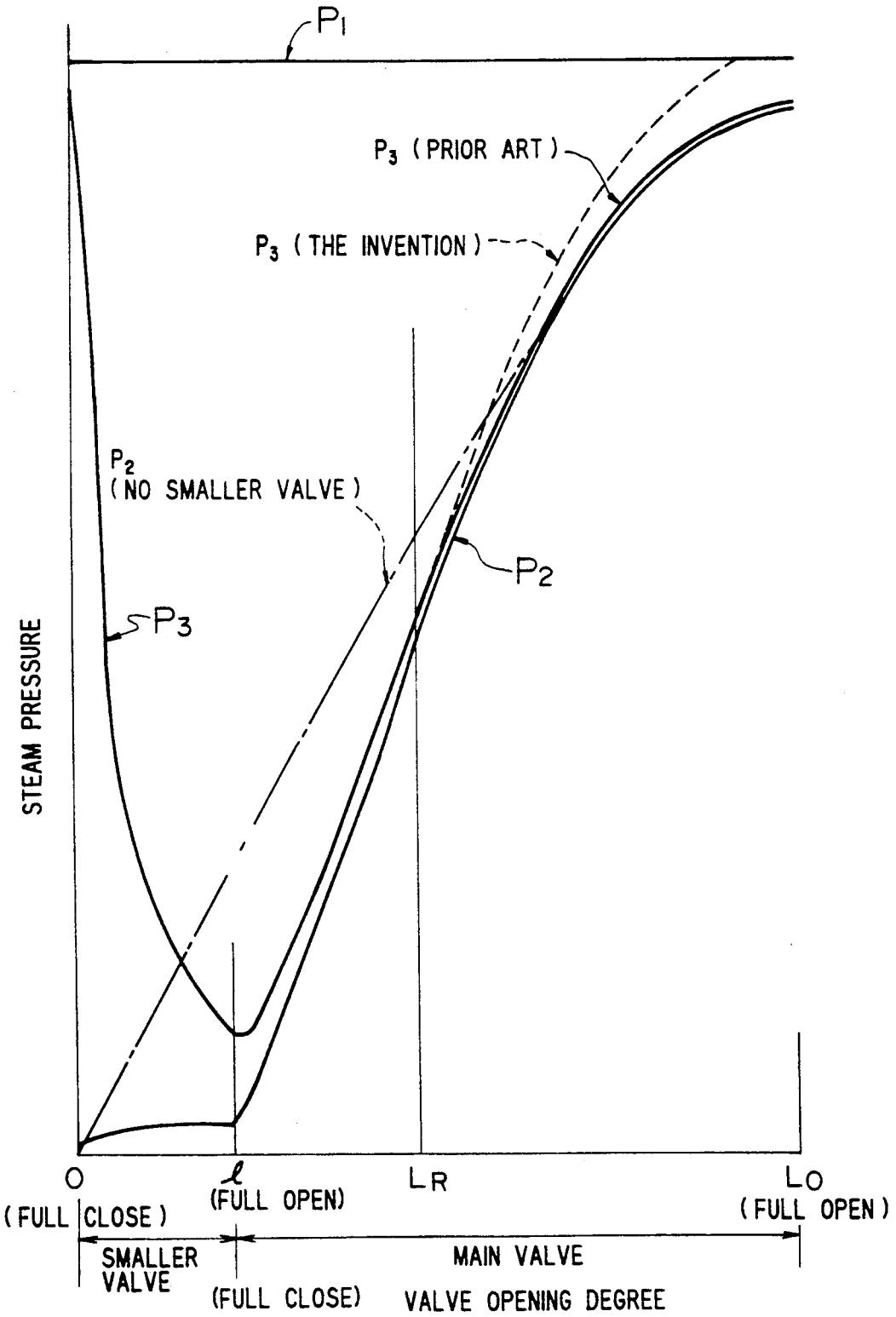
FIG. 7 is a graphical illustration of pressure characteristics of steam governing valves.

FIGS. 1 and 2 show a first embodiment of the present invention, with the main structural feature of this embodiment is the same as in the steam governing valve of the prior art described by referring to FIG. 6, and therefore, the description relating to the same features is omitted and the features different from the prior art is only described. In a steam governing valve according to the embodiment of FIGS. 1 and 2, the valve body 6 is formed on its cylindrical outer surface with a plurality (four in the embodiment shown in FIG. 2) of axially extending grooves 23 at equal intervals in a circumferential direction. Each of the axially extending grooves is so formed that a distance $L_R$ is formed between the upper end of the axially extending groove and the upper end of the valve body 6 and the axially extending groove communicates with the pressure chamber 19 when the valve body 6 moves in a valve opening direction beyond the distance $L_R$.

On the other hand, the sleeve 7 is formed with through holes 24 serving as steam passages at positions opposite to the axially extending grooves 23.

The total cross-sectional area of the flow passages defined by the axially extending plural grooves and the inner peripheral surface of the sleeve 7 and the total cross-sectional area of the plural steam flow passages formed in the sleeve are both greater than that of the flow passage 20 of the smaller valve at its full open condition.

A clearance 8 is provided on the sliding portions of the sleeve 7 and the valve body 6 extending by the distance $L_R$.

Figure 8:
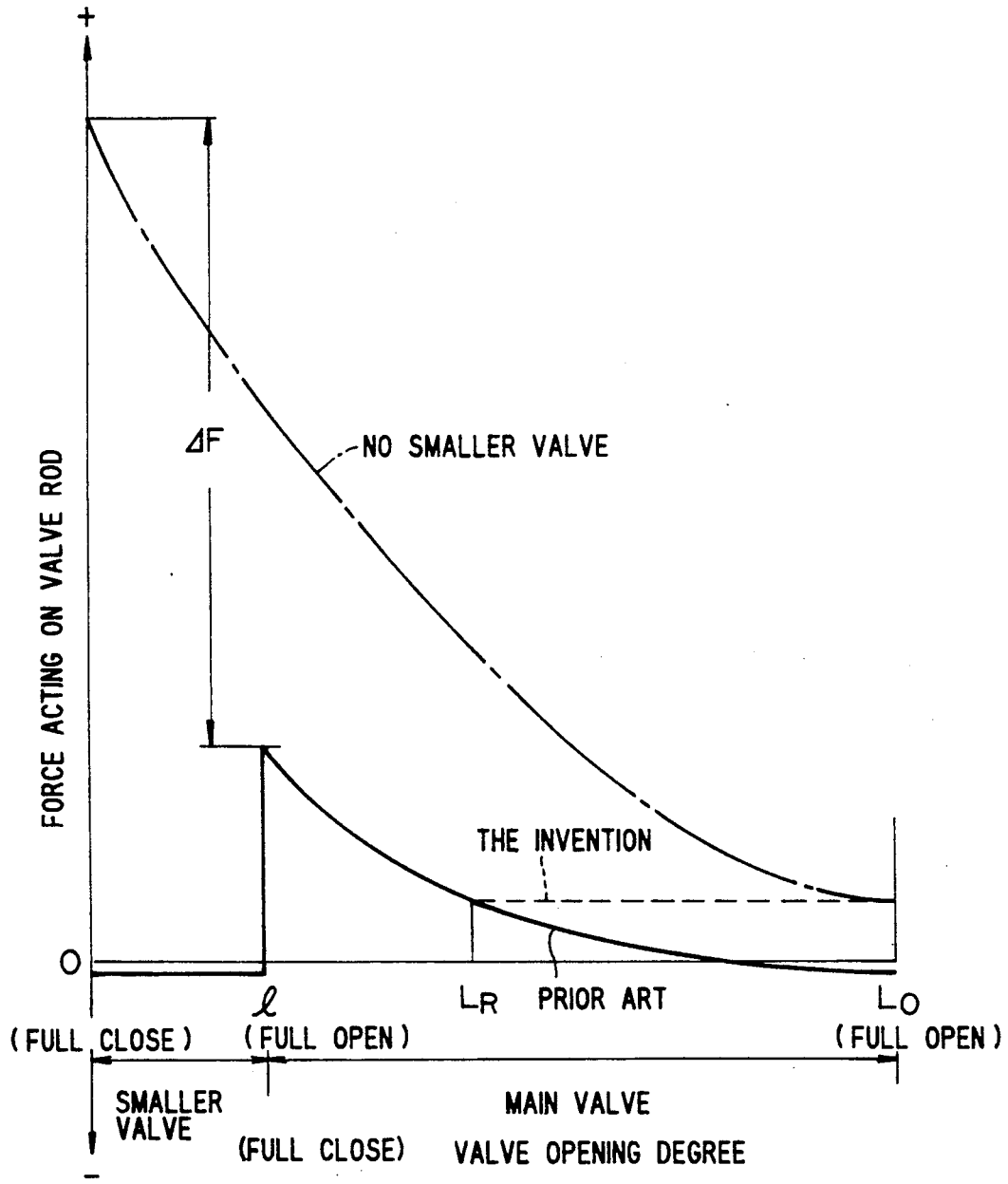
FIG. 8 is a graphical illustration of characteristics of forces acting on the valve rod.

In the steam governing valve according to the the embodiment of FIGS. 1 and 2, the force $F_P$ acting on the valve rod 4 is to be the same as in the prior art until the opening degree of the valve body 6 reaches the distance $L_R$, as shown in FIG. 8.

When the valve body 6 moves in a valve opening direction beyond a predetermined valve opening degree corresponding to the distance $L_R$, the axially extending groove formed in the valve body 6 communicates with the pressure chamber 19. As a result, the high pressure steam in the entrance chamber 18 quickly flows through the through holes formed in the sleeve 7 and the grooves 23 formed in the valve body 6 into the pressure room 19. Since the cross-sectional area of the through holes is made greater than that of the axially extending grooves, the pressure loss at the flow passages is rather small. Therefore, the pressure $P_3$ in the pressure chamber 19 is quickly increased. Based on the equation (1), the force $F_P$ acting on the valve rod 4 is shown in FIG. 8, where the force $F_P$ in case of the present invention indicated with a broken line is greater than the force in case of the prior art indicated with a solid line in a valve opening range over the opening degree $L_R$. Therefore, according to the embodiment of FIGS. 1 and 2, the engaging force between the valve rod 4 and the valve body 6 is increased, thereby suppressing the vibration of the valve body 6 and stabilizing the motion of the same.

The arrangements and functions of the first embodiment other than those described above are the same as in the prior art shown in FIG. 6.

Figure 3:
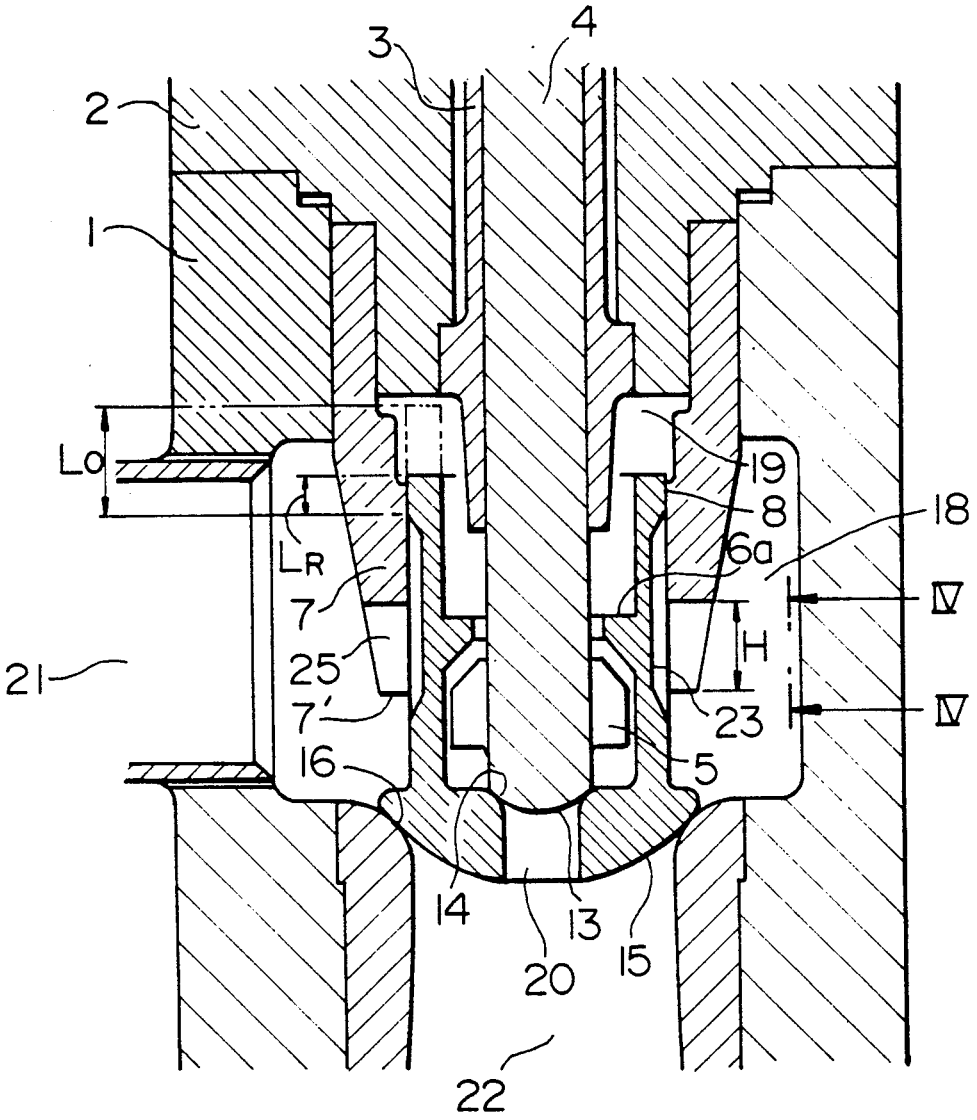
FIG. 3 is a longitudinal sectional view showing a modification of the first embodiment of the present invention.
Figure 4:
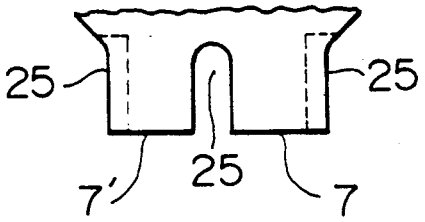
FIG. 4 is an partial side view viewed in a direction along line IV—IV of FIG. 3.

In the steam governing valve according to FIGS. 3 and 4, the sleeve 7 is formed at its lower end portion with a plurality of (four in the embodiment shown in the drawing) through grooves 25 of inverted U-shape at equal intervals in a circumferential direction. The through grooves 25 are arranged at positions opposite to the axially extending grooves 23 formed in the valve body 6, and extend by a height H from the lower end surface 7' of the sleeve 7 so that the through grooves 25 communicate with the axially extending grooves 23 even when the valve body 6 is lifted to the maximum lift $L_o$.

In the steam governing valve of FIGS. 3 and 4, when the valve body 6 moves in a valve opening direction beyond the distance $L_R$, the high pressure steam in the entrance chamber 18 flows through the through holes 25 formed in the sleeve 7 and the axially extending grooves 23 formed in the valve body 6 into the pressure chamber 19. As a result, the pressure $P_3$ in the pressure chamber 19 is increased, the force acting on the valve rod 4 is increased, and the engaging force between the valve rod 4 and the valve body 6 is increased, thereby suppressing the vibration of the valve body 6 and stabilizing the motion of the same.

Figure 5:
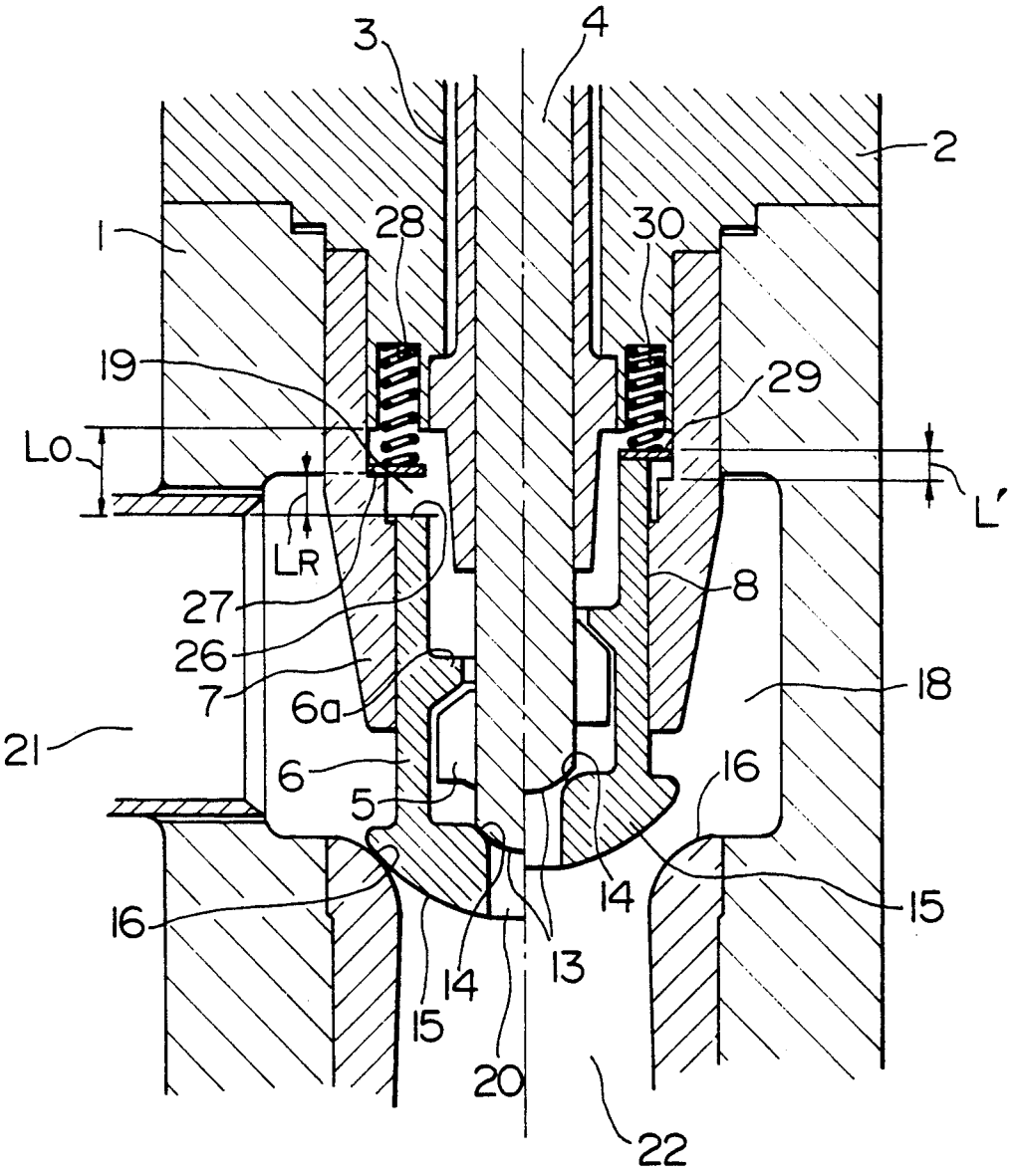
FIG. 5 is a longitudinal sectional view of a steam governing valve according to a second embodiment of the present invention.

In the embodiment of FIG. 5, the upper cover 2 is formed on the surface thereof facing to the pressure chamber 19 with a plurality of (for example, four) spring receiving recesses 28 arranged circumferentially at equal intervals. On the shoulder portion of the sleeve 7 facing to the pressure chamber 19, there is mounted a spring supporting plate 29. Between the spring receiving recesses and the spring supporting plate, a plurality of, for example, four compression springs 30 are arranged circumferentially at equal intervals.

In a steam governing valve according to the embodiment of FIG. 5, when the valve body 6 moves from the full close position shown in the left half of FIG. 5 to a position shown in the right half of FIG. 5, where the valve body 6 has moved in a valve opening direction by a predetermined distance $L_R$ added with a distance L', the spring supporting plate 29 is lifted by a force from the upper surface of the valve body 6 and all of the compression springs 30 are simultaneously compressed, thereby producing a force pressing the valve body downwards.

As a result, in the second embodiment of FIG. 5, the force acting on the valve rod 4 and the engaging force between the valve rod 4 and the valve body 6 are both increased, thereby suppressing the vibration of the valve body 6 and stabilizing the motion of the same.

Further, in the embodiment of FIG. 5, the structure for supporting the springs 30 is not limited to that shown in the figure, but it is only required that the compression springs 30 are arranged in the pressure chamber 19 above the valve body 6, and adapted to be compressed when the valve body 6 moves in a valve opening direction beyond a predetermined valve opening degree, thereby pressing the valve body 6 downwardly.

What is claimed is:

1. A steam governing valve including a valve body comprising a main valve together with a main valve seat formed on a casing body and having a smaller valve seat inside thereof; a valve rod movable in said valve body in an axial direction of the valve and including a smaller valve together with said smaller valve seat; a sleeve arranged in said casing body and guiding said valve body in an axial direction; and a pressure chamber defined by said casing body, said valve body and said sleeve, said pressure chamber being communicated with an entrance chamber through a clearance between said sleeve and said valve body, and said main valve being opened by lifting the valve rod beyond a fully open position of the smaller valve, wherein said valve body is formed, on the cylindrical outer surface thereof, with a plurality of axially extending grooves arranged at equal intervals in a circumferential direction, said sleeve is formed with a plurality of steam passages at positions opposite to said axially extending grooves, and said pressure chamber is communicated with said entrance chamber through said steam passages and said axially extending grooves when the valve body is lifted beyond a predetermined valve opening degree, and wherein the total cross-sectional area of said plurality of steam passages and the total cross-sectional area of said plurality of axially extending grooves are greater than the flow passage area of the smaller valve at the fully open condition thereof.

* * * * *